US012624304B2

(12) United States Patent
Chommeloux et al.

(10) Patent No.: US 12,624,304 B2
(45) Date of Patent: May 12, 2026

(54) LUBRICATING OIL COMPOSITIONS

(71) Applicant: Chevron Oronite Company LLC, San Ramon, CA (US)

(72) Inventors: Claire Chommeloux, San Francisco, CA (US); Alexander Boffa, Oakland, CA (US)

( * ) Notice: Subject to any disclaimer, the term of this patent is extended or adjusted under 35 U.S.C. 154(b) by 0 days.

(21) Appl. No.: 16/443,997

(22) Filed: Jun. 18, 2019

(65) Prior Publication Data

US 2019/0390133 A1 Dec. 26, 2019

Related U.S. Application Data

(60) Provisional application No. 62/688,574, filed on Jun. 22, 2018.

(51) Int. Cl.

| | |
|---|---|
| ***C10M 159/18*** | (2006.01) |
| ***C10M 159/20*** | (2006.01) |
| *C10N 30/06* | (2006.01) |
| *C10N 40/25* | (2006.01) |

(52) U.S. Cl.

CPC ..... *C10M 159/18* (2013.01); *C10M 159/20* (2013.01); *C10M 2227/06* (2013.01); *C10M 2227/09* (2013.01); *C10N 2030/06* (2013.01); *C10N 2040/25* (2013.01)

(58) Field of Classification Search

CPC ..... C10M 159/22; C10M 2207/028; C10M 159/18; C10M 159/20; C10M 2227/06; C10M 2227/09; C10N 2030/06; C10N 2040/25

See application file for complete search history.

(56) References Cited

U.S. PATENT DOCUMENTS

| | | | | |
|---|---|---|---|---|
| 3,595,791 | A | 7/1971 | Cohen | |
| 5,922,922 | A * | 7/1999 | Harris | C07C 5/2775 585/323 |
| 5,965,783 | A * | 10/1999 | Gee | C09K 8/26 585/664 |
| 6,337,310 | B1 * | 1/2002 | Campbell | C07C 15/107 508/391 |
| 6,670,513 | B1 * | 12/2003 | Campbell | B01J 29/83 568/793 |
| 8,580,717 | B2 * | 11/2013 | Sinquin | C10M 159/22 508/391 |
| 2006/0058200 | A1 | 3/2006 | Shaw | |
| 2008/0020951 | A1 | 1/2008 | Scott | |
| 2008/0167207 | A1 | 7/2008 | Nagamatsu | |
| 2008/0269351 | A1 * | 10/2008 | Campbell | C07C 37/14 514/731 |
| 2009/0170737 | A1 * | 7/2009 | Campbell | C10M 159/22 508/460 |
| 2010/0029527 | A1 * | 2/2010 | Campbell | C07C 37/14 508/567 |
| 2011/0118160 | A1 * | 5/2011 | Campbell | C10M 129/91 508/584 |
| 2011/0124539 | A1 * | 5/2011 | Sinquin | C10M 159/22 508/567 |
| 2015/0126421 | A1 * | 5/2015 | Boons | C10M 141/08 508/391 |
| 2016/0215234 | A1 * | 7/2016 | Jukes | C10M 135/02 |
| 2017/0015930 | A1 * | 1/2017 | Fletcher | C10M 129/50 |
| 2017/0211008 | A1 * | 7/2017 | Walker | C10M 159/22 |
| 2018/0044610 | A1 * | 2/2018 | Mayhew | C10M 169/048 |
| 2018/0066203 | A1 * | 3/2018 | Dance | C10M 135/10 |
| 2018/0355272 | A1 * | 12/2018 | Onodera | C10M 135/18 |
| 2019/0002783 | A1 * | 1/2019 | Gill | C10M 159/22 |
| 2019/0002784 | A1 * | 1/2019 | Boffa | C10M 135/10 |
| 2019/0185778 | A1 * | 6/2019 | Loop | C10M 159/24 |
| 2020/0181529 | A1 | 6/2020 | Suzuki et al. | |
| 2020/0208074 | A1 * | 7/2020 | Jones | C10M 141/12 |
| 2021/0230498 | A1 * | 7/2021 | Delbridge | C10M 159/22 |

FOREIGN PATENT DOCUMENTS

| | | | |
|---|---|---|---|
| CN | 107406784 | | 2/2022 |
| EP | 0317348 | | 5/1989 |
| JP | H0770141 | A | 3/1995 |
| JP | 2005306913 | A | 11/2005 |
| JP | 2008297547 | A | 12/2008 |
| JP | 2017226793 | A | 12/2017 |
| WO | 2018033785 | | 2/2018 |
| WO | 2018074522 | W | 4/2018 |
| WO | 2019003179 | | 1/2019 |

OTHER PUBLICATIONS

International Search Report, issued on Nov. 19, 2019, during the prosecution of International Application No. PCT/IB2019/055076, 4 pages.

Written Opinion of the International Searching Authority, issued on Nov. 19, 2019, during the prosecution of International Application No. PCT/IB2019/055076, 7 pages.

China Office Action, issued on Feb. 8, 2022, during the prosecution of Chinese Application No. 201980041499.1.

Written Opinion, issued on Jan. 11, 2021, during the prosecution of Singapore Application No. 11202011593X.

* cited by examiner

*Primary Examiner* — Ellen M McAvoy

(57) ABSTRACT

Disclosed is a lubricating oil composition which comprises: (a) a major amount of an oil of lubricating viscosity having a kinematic viscosity at 100° C. in a range of about 2 to about 50 $mm^2/s$, (b) an overbased metal salt of an alkyl-substituted phenate detergent, wherein the alkyl group is derived from an isomerized normal alpha olefin having from about 10 to about 40 carbon atoms per molecule and having an isomerization level (I) of the normal alpha olefin of from about 0.1 to about 0.4 in an amount to provide at least 1000 ppm of calcium, (c) one or more magnesium-containing detergents having about 100 to about 1000 ppm of magnesium, based on the total weight of the lubricating oil composition, and (d) one or more zinc dialkyl dithiophosphate compounds derived from a primary alcohol.

20 Claims, No Drawings

LUBRICATING OIL COMPOSITIONS

TECHNICAL FIELD

The disclosed technology relates to lubricants for internal combustion engines, particularly those for compression ignition engines.

BACKGROUND OF THE DISCLOSURE

Automobile spark ignition and diesel engines have valve train systems including, for example, valves, cams and rocker arms, which present special lubrication concerns. It is important that the lubricant, i.e., the engine oil, provides oxidation stability and suppresses the production of deposits in the engines to keep engine parts clean and extend engine life and oil drain intervals. Such deposits are produced from non-combustibles and incomplete combustion of hydrocarbon fuels (e.g., gasoline and diesel fuel oil) and by the deterioration of the engine oil employed. It is also important that the lubricant protects these parts from wear.

Engine oils typically use a mineral oil or a synthetic oil as a base oil. However, simple base oils alone do not provide the necessary properties to provide the necessary oxidation stability, deposit control, etc., required to protect internal combustion engines. Thus, base oils are formulated with various additives, for imparting auxiliary functions, such as ashless dispersants, metallic detergents (i.e., metal-containing detergents), antiwear agents, and antioxidants, to provide a formulated oil (i.e., a lubricating oil composition).

A number of such engine oil additives are known and employed in practice. For example, detergents are usually contained in the commercially available internal composition engine oils, especially those used for automobiles, for their detergency and antioxidant properties. One such example of detergents includes phenates. Low molecular weight alkylphenols such as tetrapropenyl phenol (TPP) have been used as a raw material by producers of sulfurized, overbased phenates. However, there is still a need to improve wear performance, such that oxidation performance is not impacted.

Accordingly, despite the advances in lubricant oil formulation technology, there still exists a need for retaining the antiwear properties while also improving oxidation performance of the engine oils.

SUMMARY OF THE DISCLOSURE

In accordance with one illustrative embodiment, a lubricating oil composition is provided which comprises:

(a) a major amount of an oil of lubricating viscosity having a kinematic viscosity at 100° C. in a range of about 2 to about 50 $mm^2/s$, (b) an overbased metal salt of an alkyl-substituted phenate detergent, wherein the alkyl group is derived from an isomerized normal alpha olefin having from about 10 to about 40 carbon atoms per molecule and having an isomerization level (I) of the normal alpha olefin of from about 0.1 to about 0.4, (c) one or more magnesium-containing detergents having about 100 to about 2000 ppm of magnesium, based on the total weight of the lubricating oil composition, and (d) one or more zinc dialkyl dithiophosphate compounds derived from a primary alcohol.

In accordance with another illustrative embodiment, a method is provided comprising the step of operating an internal combustion engine with a lubricating oil composition comprising (a) a major amount of an oil of lubricating viscosity having a kinematic viscosity at 100° C. in a range of about 2 to about 50 $mm^2/s$, (b) an overbased metal salt of an alkyl-substituted phenate detergent, wherein the alkyl group is derived from an isomerized normal alpha olefin having from about 10 to about 40 carbon atoms per molecule and having an isomerization level (I) of the normal alpha olefin of from about 0.1 to about 0.4, (c) one or more magnesium-containing detergents having about 100 to about 2000 ppm of magnesium, based on the total weight of the lubricating oil composition, and (d) one or more zinc dialkyl dithiophosphate compounds derived from a primary alcohol.

The lubricating oil compositions of the present disclosure advantageously improve oxidation, deposit control, detergency, and thermal stability of the lubricating oil performance of the present disclosure.

DETAILED DESCRIPTION OF THE DISCLOSURE

To facilitate the understanding of the subject matter disclosed herein, a number of terms, abbreviations or other shorthand as used herein are defined below. Any term, abbreviation or shorthand not defined is understood to have the ordinary meaning used by a skilled artisan contemporaneous with the submission of this application.

Definitions

In this specification, the following words and expressions, if and when used, have the meanings given below.

A "major amount" means in excess of 50 wt. % of a composition.

"Active ingredients" or "actives" refer to additive material that is not diluent or solvent.

All percentages reported are weight % on an active ingredient basis (i.e., without regard to carrier or diluent oil) unless otherwise stated.

The term "ppm" means parts per million by weight, based on the total weight of the lubricating oil composition.

Kinematic viscosity at 100° C. ($KV_{100}$) was determined in accordance with ASTM D445.

The term "metal" refers to alkali metals, alkaline earth metals, or mixtures thereof.

The term "alkali metal" refers to lithium, sodium, potassium, rubidium, and cesium.

The term "alkaline earth metal" refers to calcium, barium, magnesium, and strontium.

The term "Total Base Number" or "TBN" refers to the amount of base equivalent to milligrams of KOH in one gram of sample. Thus, higher TBN numbers reflect more alkaline products, and therefore a greater alkalinity. TBN was determined using ASTM D 2896 test.

Calcium, magnesium, phosphorus, and sulfur contents were determined in accordance with ASTM D5185.

The term "olefins" refers to a class of unsaturated aliphatic hydrocarbons having one or more carbon-carbon double bonds, obtained by a number of processes. Those containing one double bond are called mono-alkenes, and those with two double bonds are called dienes, alkyldienes, or diolefins. Alpha olefins are particularly reactive because the double bond is between the first and second carbons, e.g., 1-octene and 1-octadecene, and are used as the starting point for medium-biodegradable surfactants. Linear and branched olefins are also included in the definition of olefins.

The term "Normal Alpha Olefins" refers to olefins which are straight chain, non-branched hydrocarbons with carbon-carbon double bond present in the alpha or primary position of the hydrocarbon chain.

The term "Isomerized Normal Alpha Olefin" refers to an alpha olefin that has been subjected to isomerization conditions which results in an alteration of the distribution of the olefin species present and/or the introduction of branching along the alkyl chain. The isomerized olefin product may be obtained by isomerizing a linear alpha olefin containing from about 10 to about 40 carbon atoms, or from about 20 to about 28 carbon atoms, or from about 20 to about 24 carbon atoms.

The term "$C_{10-40}$ Normal Alpha Olefins" defines a fraction of normal alpha olefins wherein the carbon numbers below 10 have been removed by distillation or other fractionation methods.

The present disclosure is directed to a lubricating oil composition comprising (a) a major amount of an oil of lubricating viscosity having a kinematic viscosity at 100° C. in a range of about 2 to about 50 $mm^2/s$, (b) an overbased metal salt of an alkyl-substituted phenate detergent, wherein the alkyl group is derived from an isomerized normal alpha olefin having from about 10 to about 40 carbon atoms per molecule and having an isomerization level (I) of the normal alpha olefin of from about 0.1 to about 0.4, (c) one or more magnesium-containing detergents having about 100 to about 2000 ppm of magnesium, based on the total weight of the lubricating oil composition, and (d) one or more zinc dialkyl dithiophosphate compounds derived from a primary alcohol.

In general, the level of sulfur in the lubricating oil compositions of the present disclosure is less than or equal to about 0.7 wt. %, based on the total weight of the lubricating oil composition, e.g., a level of sulfur of about 0.01 wt. % to about 0.70 wt. %, or about 0.01 wt. % to about 0.6 wt. %, or about 0.01 wt. % to about 0.5 wt. %, or about 0.01 wt. % to about 0.4 wt. %, or about 0.01 wt. % to about 0.3 wt. %, or about 0.01 wt. % to about 0.2 wt. %, or about 0.01 wt. % to about 0.10 wt. %, based on the total weight of the lubricating oil composition. In one embodiment, the level of sulfur in the lubricating oil compositions of the present disclosure is less than or equal to about 0.60 wt. %, or less than or equal to about 0.50 wt. %, or less than or equal to about 0.40 wt. %, or less than or equal to about 0.30 wt. %, or less than or equal to about 0.28 wt. %, or less than or equal to about 0.20 wt. %, or less than or equal to about 0.10 wt. % based on the total weight of the lubricating oil composition.

In one embodiment, the level of phosphorus in the lubricating oil compositions of the present disclosure is less than or equal to about 0.12 wt. %, based on the total weight of the lubricating oil composition, e.g., a level of phosphorus of about 0.01 wt. % to about 0.12 wt. %. In one embodiment, the level of phosphorus in the lubricating oil compositions of the present disclosure is less than or equal to about 0.11 wt. %, based on the total weight of the lubricating oil composition, e.g., a level of phosphorus of about 0.01 wt. % to about 0.11 wt. %. In one embodiment, the level of phosphorus in the lubricating oil compositions of the present disclosure is less than or equal to about 0.10 wt. %, based on the total weight of the lubricating oil composition, e.g., a level of phosphorus of about 0.01 wt. % to about 0.10 wt. %. In one embodiment, the level of phosphorus in the lubricating oil compositions of the present disclosure is less than or equal to about 0.099 wt. %, based on the total weight of the lubricating oil composition, e.g., a level of phosphorus of about 0.01 wt. % to about 0.099 wt. %. In one embodiment, the level of phosphorus in the lubricating oil compositions of the present disclosure is less than or equal to about 0.08 wt. %, based on the total weight of the lubricating oil composition, e.g., a level of phosphorus of about 0.01 wt. % to about 0.08 wt. %. In one embodiment, the level of phosphorus in the lubricating oil compositions of the present disclosure is less than or equal to about 0.07 wt. %, based on the total weight of the lubricating oil composition, e.g., a level of phosphorus of about 0.01 wt. % to about 0.07 wt. %. In one embodiment, the level of phosphorus in the lubricating oil compositions of the present disclosure is less than or equal to about 0.05 wt. %, based on the total weight of the lubricating oil composition, e.g., a level of phosphorus of about 0.01 wt. % to about 0.05 wt. %.

In one embodiment, the level of sulfated ash produced by the lubricating oil compositions of the present disclosure is less than or equal to about 1.60 wt. % as determined by ASTM D 874, e.g., a level of sulfated ash of from about 0.10 wt. % to about 1.60 wt. % as determined by ASTM D 874. In one embodiment, the level of sulfated ash produced by the lubricating oil compositions of the present disclosure is less than or equal to about 1.00 wt. % as determined by ASTM D 874, e.g., a level of sulfated ash of from about 0.10 wt. % to about 1.00 wt. % as determined by ASTM D 874. In one embodiment, the level of sulfated ash produced by the lubricating oil compositions of the present disclosure is less than or equal to about 0.80 wt. % as determined by ASTM D 874, e.g., a level of sulfated ash of from about 0.10 wt. % to about 0.80 wt. % as determined by ASTM D 874. In one embodiment, the level of sulfated ash produced by the lubricating oil compositions of the present disclosure is less than or equal to about 0.60 wt. % as determined by ASTM D 874, e.g., a level of sulfated ash of from about 0.10 wt. % to about 0.60 wt. % as determined by ASTM D 874. In another embodiment, the level of sulfated ash produced by the lubricating oil compositions of the present disclosure is less than or equal to about 1.1 to 1.2 wt. % as determined by ASTM D 874.

The lubricating oil composition in accordance with the present disclosure includes an oil of lubricating viscosity (sometimes referred to as "base stock" or "base oil"). The expression "base oil" as used herein shall be understood to mean a base stock or blend of base stocks which is a lubricant component that is produced by a single manufacturer to the same specifications (independent of feed source or manufacturer's location); that meets the same manufacturer's specification; and that is identified by a unique formula, product identification number, or both. The oil of lubricating viscosity is the primary liquid constituent of a lubricant, into which additives and possibly other oils are blended, for example to produce a final lubricant (or lubricant composition). A base oil is useful for making concentrates as well as for making lubricating oil compositions therefrom, and may be selected from natural and synthetic lubricating oils and combinations thereof.

Natural oils include animal and vegetable oils, liquid petroleum oils and hydrorefined, solvent-treated mineral lubricating oils of the paraffinic, naphthenic and mixed paraffinic-naphthenic types. Oils of lubricating viscosity derived from coal or shale are also useful base oils.

Synthetic lubricating oils include hydrocarbon oils such as polymerized and interpolymerized olefins (e.g., polybutylenes, polypropylenes, propylene-isobutylene copolymers, chlorinated polybutylenes, poly(l-hexenes), poly(l-octenes), and poly(1-decenes)); alkylbenzenes (e.g., dodecylbenzenes, tetradecylbenzenes, dinonylbenzenes, and di(2-ethylhexyl)benzenes); alkylated naphthalene; polyphenols (e.g., biphenyls, terphenyls, and alkylated polyphenols); and alkylated diphenyl ethers and alkylated diphenyl sulfides and the derivatives, analogues and homologues thereof.

Another suitable class of synthetic lubricating oils comprises the esters of dicarboxylic acids (e.g., malonic acid, alkyl malonic acids, alkenyl malonic acids, succinic acid, alkyl succinic acids and alkenyl succinic acids, maleic acid, fumaric acid, azelaic acid, suberic acid, sebacic acid, adipic acid, linoleic acid dimer, and phthalic acid) with a variety of alcohols (e.g., butyl alcohol, hexyl alcohol, dodecyl alcohol, 2-ethylhexyl alcohol, ethylene glycol, diethylene glycol monoether, and propylene glycol). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols, and polyol ethers such as neopentyl glycol, trimethylolpropane, pentaerythritol, dipentaerythritol and tripentaerythritol.

The base oil may be derived from Fischer-Tropsch synthesized hydrocarbons. Fischer-Tropsch synthesized hydrocarbons are made from synthesis gas containing $H_2$ and CO using a Fischer-Tropsch catalyst. Such hydrocarbons typically require further processing in order to be useful as the base oil. For example, the hydrocarbons may be hydroisomerized; hydrocracked and hydroisomerized; dewaxed; or hydroisomerized and dewaxed; using processes known to those skilled in the art.

Unrefined, refined and re-refined oils can be used in the present lubricating oil composition. Unrefined oils are those obtained directly from a natural or synthetic source without further purification treatment. For example, a shale oil obtained directly from retorting operations, a petroleum oil obtained directly from distillation or ester oil obtained directly from an esterification process and used without further treatment would be unrefined oil. Refined oils are similar to the unrefined oils except they have been further treated in one or more purification steps to improve one or more properties. Many such purification techniques, such as distillation, solvent extraction, acid or base extraction, filtration and percolation are known to those skilled in the art.

Re-refined oils are obtained by processes similar to those used to obtain refined oils applied to refined oils which have been already used in service. Such re-refined oils are also known as reclaimed or reprocessed oils and often are additionally processed by techniques for approval of spent additive and oil breakdown products.

Hence, the base oil which may be used to make the present lubricating oil composition may be selected from any of the base oils in Groups I-V as specified in the American Petroleum Institute (API) Base Oil Interchangeability Guidelines (API Publication 1509). Such base oil groups are summarized in Table 1 below:

TABLE 1

| | Base Oil Properties | | |
|---|---|---|---|
| Group[a] | Saturates[b], wt. % | Sulfur[c], wt. % | Viscosity Index[d] |
| Group I | <90 and/or | >0.03 | 80 to <120 |
| Group II | ≥90 | ≤0.03 | 80 to <120 |
| Group III | ≥90 | ≤0.03 | ≥120 |

TABLE 1-continued

| | Base Oil Properties | | |
|---|---|---|---|
| Group[a] | Saturates[b], wt. % | Sulfur[c], wt. % | Viscosity Index[d] |
| Group IV | Polyalphaolefins (PAOs) | | |
| Group V | All other base stocks not included in Groups I, II, III or IV | | |

[a]Groups I-III are mineral oil base stocks.
[b]Determined in accordance with ASTM D2007.
[c]Determined in accordance with ASTM D2622, ASTM D3120, ASTM D4294 or ASTM D4927.
[d]Determined in accordance with ASTM D2270.

Base oils suitable for use herein are any of the variety corresponding to API Group II, Group III, Group IV, and Group V oils and combinations thereof, preferably the Group III to Group V oils due to their exceptional volatility, stability, viscometric and cleanliness features.

The oil of lubricating viscosity for use in the lubricating oil compositions of this disclosure, also referred to as a base oil, is typically present in a major amount, e.g., an amount of greater than 50 wt. %, or greater than about 70 wt. %, or great than about 80%, based on the total weight of the lubricating oil composition. In one embodiment, the oil of lubricating viscosity can be present in the lubricating oil composition of this disclosure in an amount of less than about 90 wt. % or less than about 85 wt. %, based on the total weight of the lubricating oil composition. The base oil for use herein can be any presently known or later-discovered oil of lubricating viscosity used in formulating lubricating oil compositions for engine oils. Additionally, the base oils for use herein can optionally contain viscosity index improvers, e.g., polymeric alkylmethacrylates; olefinic copolymers, e.g., an ethylene-propylene copolymer or a styrene-butadiene copolymer; and the like and mixtures thereof. The topology of viscosity modifier could include, but is not limited to, linear, branched, hyperbranched, star, or comb topology.

As one skilled in the art would readily appreciate, the viscosity of the base oil is dependent upon the application. Accordingly, the viscosity of a base oil for use herein will ordinarily range from about 2 to about 2000 centistokes (cSt) at 100° Centigrade (C.). Generally, individually the base oils used as engine oils will have a kinematic viscosity range at 100° C. of about 2 cSt to about 30 cSt, or about 3 cSt to about 16 cSt, or about 4 cSt to about 12 cSt and will be selected or blended depending on the desired end use and the additives in the finished oil to give the desired grade of engine oil, e.g., a lubricating oil composition having an SAE Viscosity Grade of 0W, 0W-8, 0W-12, 0W-16, 0W-20, 0W-26, 0W-30, 0W-40, 0W-50, 0W-60, 5W, 5W-20, 5W-30, 5W-40, 5W-50, 5W-60, 10W, 10W-20, 10W-30, 10W-40, 10W-50, 15W, 15W-20, 15W-30, 15W-40, 30, 40 and the like.

The lubricating oil composition in accordance with the present disclosure further includes an overbased metal salt of an alkyl-substituted phenate detergent, wherein the alkyl group is derived from an isomerized normal alpha olefin having from about 10 to about 40 carbon atoms per molecule having an isomerization level (I) of the normal alpha olefin of from about 0.1 to about 0.4. In general, isomerized phenate detergents are useful for their detergency and antioxidant properties. In addition, metal salts of isomerized phenate detergents made from isomerized normal alpha olefin, have a reduced content of unreacted TPP, which in a recent reproductive toxicity study in rats sponsored by the Petroleum Additives Panel of the American Chemistry Counsel showed that in high concentrations unreacted TPP may cause adverse effects in male and female reproductive organs.

In one aspect of the present disclosure, the phenate detergent is an alkylated phenate detergent wherein the alkyl group is derived from an isomerized normal alpha olefin having from about 10 to about 40 carbon atoms per molecule.

In one aspect of the present disclosure, the alkyl group of the alkylated phenate detergent is derived from an isomerized normal alpha olefin having from about 14 to about 30, or from about 16 to about 30, or from about 18 to about 30, or from about 20 to about 28, or from about 20 to about 24, or from about 18 to about 28 carbon atoms per molecule.

In one aspect of the present disclosure, an isomerization level (I) of the normal alpha olefin of the alkylated phenate detergent is between from about 0.10 to about 0.40, or from about 0.10 to about 0.30, or from about 0.12 to about 0.30, or from about 0.22 to about 0.30.

In another embodiment, the isomerization level of the normal alpha olefin is about 0.26, and the normal alpha olefin has from about 20 to about 24 carbon atoms.

In one aspect of the present disclosure, the overbased metal salt of an alkyl-substituted phenate detergent has a TBN of from about 100 to about 600, or from about 150 to about 500, or from about 150 to about 450, or from about 200 to about 450, or from about 250 to about 450, or from about 300 to about 450, or from about 350 to about 450, or from about 300 to about 425, or from about 325 to about 425, or from about 350 to about 425 mg KOH/gram, on an oil free basis.

In one aspect of the present disclosure, the overbased metal salt of an alkyl-substituted phenate detergent is a calcium phenate detergent.

In one aspect of the present disclosure, the overbased metal salt of an alkyl-substituted phenate detergent is a calcium non-sulfurized phenate detergent.

In one aspect of the present disclosure, the overbased metal salt of an alkyl-substituted phenate detergent can be prepared as described in, for example, U.S. Pat. No. 8,580,717 which is herein incorporated in its entirety.

In general, the overbased metal salt of an alkyl-substituted phenate detergent is present in the lubricating oil composition in an amount of about 10 ppm to about 5000 ppm of metal, e.g., calcium, based on the total weight of the lubricating oil composition. In one embodiment, an overbased metal salt of an alkyl-substituted phenate detergent is present in the lubricating oil composition in an amount of about 50 ppm to about 4000 ppm of metal, based on the total weight of the lubricating oil composition. In one embodiment, an overbased metal salt of an alkyl-substituted phenate detergent is present in the lubricating oil composition in an amount of about 100 ppm to about 3000 ppm of metal, based on the total weight of the lubricating oil composition. In one embodiment, an overbased metal salt of an alkyl-substituted phenate detergent is present in the lubricating oil composition in an amount of from about 300 ppm to about 3000 ppm, from about 500 ppm to about 3000 ppm, from about 600 ppm to about 3000 ppm, from about 800 ppm to about 3000 ppm, from about 1000 ppm to about 3000 ppm, from about 1500 ppm to about 3000 ppm, from about 1600 ppm to about 2800 ppm, from about 1650 ppm to about 2700 ppm of metal, based on the total weight of the lubricating oil composition.

In another embodiment, the overbased metal salt of an alkyl-substituted phenate detergent is present in the lubricating oil composition to provide at least 1000 ppm calcium, based on the total weight of the lubricating oil composition. In other embodiments, the overbased metal salt of an alkyl-substituted phenate detergent is present in the lubricating oil composition to provide at least 1100 ppm, at least 1200 ppm, at least 1300 ppm, at least 1400 ppm, at least 1500 ppm, at least 1600 ppm, at least 1680 ppm calcium, based on the total weight of the lubricating oil composition.

In one embodiment, the overbased metal salt of an alkyl-substituted phenate detergent is present in the lubricating oil composition in an amount of about 0.1 wt. % to about 3 wt. %, based on the total weight of the lubricating oil composition. In one embodiment, the overbased metal salt of an alkyl-substituted phenate detergent is present in the lubricating oil composition in an amount of about 0.2 wt. % to about 2 wt. %, based on the total weight of the lubricating oil composition. In one embodiment, the overbased metal salt of an alkyl-substituted phenate detergent is present in the lubricating oil composition in an amount of about 0.5 wt. % to about 1.4 wt. %, based on the total weight of the lubricating oil composition.

The lubricating oil composition in accordance with the present disclosure further includes at least about 100 to about 1200 ppm of magnesium from one or more magnesium-containing detergents based on the total weight of the lubricating oil composition. In other embodiments, the one or more magnesium-containing detergents provide from about 100 to about 1000 ppm, from about 150 to about 1000 ppm, from about 200 to about 1000 ppm, from about 200 to about 950 ppm, from about 200 to about 900 ppm, from about 225 to about 900 ppm, from about 225 to about 875 ppm, from about 250 to about 850 ppm of magnesium to the lubricating oil composition, based on the total weight of the lubricating oil composition.

Suitable magnesium-containing detergents include, for example, one or more of a magnesium-containing sulfonates, magnesium-containing phenates, magnesium-containing salicylates, magnesium-containing carboxylates, and magnesium-containing phosphates. In one embodiment, a suitable magnesium-containing detergent includes one or more of a magnesium sulfonate, a magnesium phenate, and a magnesium salicylate. In one embodiment, a magnesium-containing detergent is a magnesium sulfonate.

Sulfonates may be prepared from sulfonic acids which are typically obtained by the sulfonation of alkyl-substituted aromatic hydrocarbons such as those obtained from the fractionation of petroleum or by the alkylation of aromatic hydrocarbons. Examples included those obtained by alkylating benzene, toluene, xylene, naphthalene, diphenyl or their halogen derivatives. The alkylation may be carried out in the presence of a catalyst with alkylating agents having from about 3 to more than 70 carbon atoms. The alkaryl sulfonates usually contain from about 9 to 80 or more carbon atoms (e.g., about 16 to 60 carbon atoms) per alkyl substituted aromatic moiety.

Phenates can be prepared by reacting an alkaline earth metal hydroxide or oxide (e.g., CaO, $Ca(OH)_2$, MgO, or $Mg(OH)_2$) with an alkyl phenol or sulfurized alkylphenol. Suitable alkyl groups include, for example, straight or branched chain $C_1$ to $C_{30}$ (e.g., $C_4$ to $C_{20}$) alkyl groups, or mixtures thereof. Suitable phenols include, for example, isobutylphenol, 2-ethylhexylphenol, nonylphenol, dodecyl phenol, and the like. It should be noted that starting alkylphenols may contain more than one alkyl substituent that are each independently straight chain or branched chain. When a non-sulfurized alkylphenol is used, the sulfurized product may be obtained by methods well known in the art. These methods include heating a mixture of alkylphenol and sulfurizing agent (e.g., elemental sulfur, sulfur halides such as sulfur dichloride, and the like) and then reacting the sulfurized phenol with an alkaline earth metal base.

Salicylates may be prepared by reacting a basic metal compound with at least one carboxylic acid and removing water from the reaction product. Detergents made from salicylic acid are one class of detergents prepared from carboxylic acids. Suitable salicylates include, for example, long chain alkyl salicylates. One useful family of compositions is of the following structure (I):

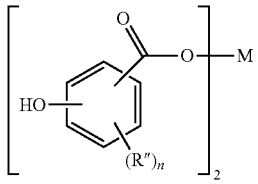

(I)

wherein R" is a $C_1$ to $C_{30}$ (e.g., $C_{13}$ to $C_{30}$) alkyl group; n is an integer from 1 to 4; and M is an alkaline earth metal (e.g., Ca or Mg).

Hydrocarbyl-substituted salicylic acids may be prepared from phenols by the Kolbe reaction (see U.S. Pat. No. 3,595,791). The metal salts of the hydrocarbyl-substituted salicylic acids may be prepared by double decomposition of a metal salt in a polar solvent such as water or alcohol.

Alkaline earth metal phosphates are also used as detergents and are known in the art.

In one aspect of the present disclosure, the one or more magnesium-containing detergents are one or more overbased magnesium-containing detergents. Overbased detergents help neutralize acidic impurities produced by the combustion process and become entrapped in the oil. Typically, the overbased material has a ratio of metallic ion to anionic portion of the detergent of about 1.05:1 to about 50:1 (e.g., about 4:1 to about 25:1) on an equivalent basis. In one embodiment, the one or more magnesium-containing detergents are one or more overbased magnesium detergents having a TBN (oil free basis) of 0 to about 60. In another embodiment, the one or more magnesium-containing detergents are one or more overbased magnesium detergents having a TBN (oil free basis) of greater than 60 to about 200. In another embodiment, the one or more magnesium-containing detergents are one or more overbased magnesium detergents having a TBN (oil free basis) of greater than about 200 to about 800.

In general, the one or more magnesium-containing detergents are used in an amount that provides the lubricating oil compositions of the present disclosure with from about 100 ppm to about 2000 ppm of magnesium, based on the total weight of the lubricating oil composition. In one embodiment, the one or more magnesium-containing detergents may be used in an amount that provides the lubricating oil compositions of the present disclosure with from about 200 ppm to about 1500 ppm of magnesium, based on the total weight of the lubricating oil composition. In one embodiment, the one or more magnesium-containing detergents may be used in an amount that provides the lubricating oil compositions of the present disclosure with from about 300 ppm to about 900 ppm of magnesium, based on the total weight of the lubricating oil composition.

The lubricating oil composition in accordance with the present disclosure further includes one or more zinc dialkyl dithiophosphate compounds derived from a primary alcohol. Suitable primary alcohols include those alcohols containing from 1 to 18 carbon atoms such as methanol, ethanol, propanol, butanol, pentanol, hexanol, heptanol, octanol, nonanol, decanol, dodecanol, octadecanol, propenol, butenol, and 2-ethylhexanol. In one embodiment, a zinc dialkyl dithiophosphate (ZnDTP) derived from a primary alcohol can be represented by a structure of formula (II):

$$Zn[S—P(=S)(OR^1)(OR^2)]_2 \quad (II)$$

wherein $R^1$ and $R^2$ may be the same or different alkyl radicals having from 1 to 18 carbon atoms or 2 to 12 carbon atoms or from 2 to 8 carbon atoms. The $R^1$ and $R^2$ groups of the zinc dialkyl dithiophosphate are derived from a primary alcohol as described above. In order to obtain oil solubility, the total number of carbon atoms (i.e., $R^1$+$R^2$) will be at least 5.

In one embodiment, a mixture can be used comprising one or more zinc dialkyl dithiophosphate compounds derived from a primary alcohol and one or more zinc dialkyl dithiophosphate compounds derived from a secondary alcohol, wherein the molar ratio of the primary alcohol to the secondary alcohol is from about 100:0 to about 10:100. Suitable secondary alcohols include those alcohols containing from 3 to 18 carbon atoms such as isopropyl alcohol, secondary butyl alcohol, isobutanol, 3-methylbutan-2-ol, 2-pentanol, 4-methyl-2-pentanol, 2-hexanol, 3-hexanol, and amyl alcohol. In one embodiment, a zinc dialkyl dithiophosphate (ZnDTP) derived from a secondary alcohol can be represented by a structure of formula (III):

$$Zn[S—P(=S)(OR^1)(OR^2)]_2 \quad (III)$$

wherein $R^1$ and $R^2$ may be the same or different alkyl radicals having from 3 to 18 carbon atoms or 3 to 12 carbon atoms or from 3 to 8 carbon atoms. The $R^1$ and $R^2$ groups of the zinc dialkyl dithiophosphate can be derived from the foregoing secondary alcohols. In order to obtain oil solubility, the total number of carbon atoms (i.e., $R^1$+$R^2$) will be at least 5.

In one embodiment, the molar ratio of the primary alcohol to the secondary alcohol in the mixture of the one or more zinc dialkyl dithiophosphate compounds derived from a primary alcohol and one or more zinc dialkyl dithiophosphate compounds derived from a secondary alcohol can range from about 20:80 to about 80:20. In one embodiment, the molar ratio of the primary alcohol to the secondary alcohol in the mixture of the one or more zinc dialkyl dithiophosphate compounds derived from a primary alcohol and one or more zinc dialkyl dithiophosphate compounds derived from a secondary alcohol can range from about 30:70 to about 70:30. In one embodiment, the molar ratio of the primary alcohol to the secondary alcohol in the mixture of the one or more zinc dialkyl dithiophosphate compounds derived from a primary alcohol and one or more zinc dialkyl dithiophosphate compounds derived from a secondary alcohol can range from about 40:60 to about 60:40.

In general, the one or more zinc dialkyl dithiophosphate compounds derived from a primary alcohol and/or one or more zinc dialkyl dithiophosphate compounds derived from a secondary alcohol can be present in the lubricating oil composition of the present disclosure in an amount of about 3 wt. % or less, based on the total weight of the lubricating oil composition, e.g., an amount of about 0.1 wt. % to about 3 wt. %. In one embodiment, the one or more zinc dialkyl dithiophosphate compounds derived from a primary alcohol and/or one or more zinc dialkyl dithiophosphate compounds derived from a secondary alcohol can be present in the lubricating oil composition of the present disclosure in an amount of about 0.1 to about 1.5 wt. %, based on the total weight of the lubricating oil composition. In one embodiment, the one or more zinc dialkyl dithiophosphate compounds derived from a primary alcohol and/or one or more zinc dialkyl dithiophosphate compounds derived from a secondary alcohol can be present in the lubricating oil composition of the present disclosure in an amount of about 0.5 to about 1.0 wt. %, based on the total weight of the lubricating oil composition.

If desired, the lubricating oil composition of the present disclosure can further contain one or more additional detergents. In one embodiment, the lubricating oil compositions of the present disclosure further contain one or more alkali metal or alkaline earth metal sulfonates. For example, the lubricating oil composition of the present disclosure can contain one or more calcium sulfonates. In one embodiment, a calcium sulfonate is one or more overbased calcium detergents. In one embodiment, a calcium sulfonate is an overbased calcium detergent having a TBN (oil free basis) of 0 to about 60. In another embodiment, the calcium sulfonate is an overbased calcium detergent having a TBN (oil free basis) of greater than 60 to about 200. In another embodiment, the calcium sulfonate is an overbased calcium detergent having a TBN (oil free basis) of greater than about 200 to about 800.

The lubricating oil compositions of the present disclosure may also contain other conventional additives that can impart or improve any desirable property of the lubricating oil composition in which these additives are dispersed or dissolved. Any additive known to a person of ordinary skill in the art may be used in the lubricating oil compositions disclosed herein. Some suitable additives have been described in Mortier et al., "Chemistry and Technology of Lubricants", 2nd Edition, London, Springer, (1996); and Leslie R. Rudnick, "Lubricant Additives: Chemistry and Applications", New York, Marcel Dekker (2003), both of which are incorporated herein by reference. For example, the lubricating oil compositions can be blended with antioxidants, rust inhibitors, dehazing agents, demulsifying agents, metal deactivating agents, friction modifiers, pour point depressants, antifoaming agents, co-solvents, corrosion-inhibitors, ashless dispersants, multifunctional agents, dyes, extreme pressure agents and the like and mixtures thereof. A variety of the additives are known and commercially available. These additives, or their analogous compounds, can be employed for the preparation of the lubricating oil compositions of the disclosure by the usual blending procedures.

In the preparation of lubricating oil formulations, it is common practice to introduce the additives in the form of about 10 to about 80 wt. % active ingredient concentrates in hydrocarbon oil, e.g. mineral lubricating oil, or other suitable solvent.

Usually these concentrates may be diluted with about 3 to about 100, e.g., about 5 to about 40, parts by weight of lubricating oil per part by weight of the additive package in forming finished lubricants, e.g. crankcase motor oils. The purpose of concentrates, of course, is to make the handling of the various materials less difficult and awkward as well as to facilitate solution or dispersion in the final blend.

Each of the foregoing additives, when used, is used at a functionally effective amount to impart the desired properties to the lubricant. Thus, for example, if an additive is a friction modifier, a functionally effective amount of this friction modifier would be an amount sufficient to impart the desired friction modifying characteristics to the lubricant.

In general, the concentration of each of the additives in the lubricating oil composition, when used, may range from about 0.001 wt. % to about 20 wt. %, or from about 0.005 wt. % to about 15 wt. %, or from about 0.01 wt. % to about 10 wt. %, or from about 0.1 wt. % to about 5 wt. %, or from about 0.1 wt. % to about 2.5 wt. %, based on the total weight of the lubricating oil composition. Further, the total amount of the additives in the lubricating oil composition may range from about 0.001 wt. % to about 20 wt. %, or from about 0.01 wt. % to about 10 wt. %, or from about 0.1 wt. % to about 5 wt. %, based on the total weight of the lubricating oil composition.

The following examples are presented to exemplify embodiments of the disclosure but are not intended to limit the disclosure to the specific embodiments set forth. Specific details described in each example should not be construed as necessary features of the disclosure. The following examples are intended for illustrative purposes only and do not limit in any way the scope of the present disclosure. All numerical values are approximate. When numerical ranges are given, it should be understood that embodiments outside the stated ranges may still fall within the scope of the disclosure.

The isomerization level was measured by an NMR method as follows.

Isomerization level (I) and NMR method.

The isomerization level (I) of the olefin was determined by hydrogen-1 (1H) NMR. The NMR spectra were obtained on a Bruker Ultrashield Plus 400 in chloroform-d1 at 400 MHz using TopSpin 3.2 spectral processing software.

The isomerization level (I) represents the relative amount of methyl groups ($CH_3$) (chemical shift 0.30-1.01 ppm) attached to the methylene backbone groups (—$CH_2$—) (chemical shift 1.01-1.38 ppm) and is defined by Equation (1) as shown below, $$I=m/(m+n) \qquad \text{Equation (1)}$$

where m is NMR integral for methyl groups with chemical shifts between 0.30±0.03 to 1.01±0.03 ppm, and n is NMR integral for methylene groups with chemical shifts between 1.01±0.03 to 1.38±0.10 ppm.

Example 1

A lubricating oil composition was prepared that contained a major amount of a base oil of lubricating viscosity and the following additives, to provide a finished oil having an SAE viscosity of 15W-40:

- an ethylene carbonate post-treated bis-succinimide;
- 850 ppm in terms of magnesium content, of a 670 TBN (oil free basis) magnesium sulfonate detergent;
- a low overbased calcium detergent;
- 1680 ppm of Ca of a 400 TBN (oil free basis) calcium alkylated phenate detergent, wherein the alkyl group is derived from a $C_{20}$ to $C_{24}$ isomerized normal alpha olefin and wherein the isomerization level of the alpha olefin is about 0.26;
- 990 ppm in terms of phosphorus content, of a mixture of primary and secondary zinc dialkyldithiophosphate in a 50:50 molar ratio of primary to secondary alcohols;
- a molybdenum succinimide antioxidant;
- an alkylated diphenylamine;
- 5 ppm in terms of silicon content, of a foam inhibitor;
- a non-dispersant olefin copolymer viscosity modifier; and the remainder, a Group II base oil having a kinematic viscosity of 6.4 cSt at 100° C.

Comparative Example 2

A lubricating oil composition was prepared similar to Example 1 except the ratio for the molar ratio of primary to secondary zinc. that contained a major amount of a base oil of lubricating viscosity. In this example there was 990 ppm in terms of phosphorus content, of an all secondary zinc dialkyldithiophosphate.

Example 3

A lubricating oil composition was prepared similar to Example 1 except the ratio for the molar ratio of primary to secondary zinc. that contained a major amount of a base oil of lubricating viscosity. In this example there was 990 ppm in terms of phosphorus content, of a mixture of primary and secondary zinc dialkyldithiophosphate in a 20:80 molar ratio of primary to secondary.

Example 4

A lubricating oil composition was prepared similar to Example 1 except the ratio for the molar ratio of primary to secondary zinc. that contained a major amount of a base oil of lubricating viscosity. In this example there was 990 ppm in terms of phosphorus content, of a mixture of primary and secondary zinc dialkyldithiophosphate in a 80:20 molar ratio of primary to secondary.

Example 5

A lubricating oil composition was prepared similar to Example 1 except the ratio for the molar ratio of primary to secondary zinc. that contained a major amount of a base oil of lubricating viscosity. In this example there was 990 ppm in terms of phosphorus content, of a an all primary zinc dialkyldithiophosphate.

Example 6

A lubricating oil composition was prepared similar to Example 1 except there was 250 ppm in terms of magnesium content, of a 670 TBN (oil free basis) magnesium sulfonate detergent and 2600 ppm of Ca of a 400 TBN (oil free basis) calcium alkylated phenate detergent, wherein the alkyl group is derived from a $C_{20}$ to $C_{24}$ isomerized normal alpha olefin and wherein the isomerization level of the alpha olefin is about 0.26.

Example 7

A lubricating oil composition was prepared similar to Example 1 except there was 500 ppm in terms of magnesium content, of a 670 TBN (oil free basis) magnesium sulfonate detergent and 2230 ppm of Ca of a 400 TBN (oil free basis) calcium alkylated phenate detergent, wherein the alkyl group is derived from a $C_{20}$ to $C_{24}$ isomerized normal alpha olefin and wherein the isomerization level of the alpha olefin is about 0.26.

Comparative Example 8

A lubricating oil composition was prepared similar to Example 1 except there was 1220 ppm in terms of magnesium content, of a 670 TBN (oil free basis) magnesium sulfonate detergent and 1110 ppm of Ca of a 400 TBN (oil free basis) calcium alkylated phenate detergent, wherein the alkyl group is derived from a $C_{20}$ to $C_{24}$ isomerized normal alpha olefin and wherein the isomerization level of the alpha olefin is about 0.26.

Comparative Example 9

A lubricating oil composition was prepared similar to Example 1 except there was 1700 ppm in terms of magnesium content, of a 670 TBN (oil free basis) magnesium sulfonate detergent and 360 ppm of Ca of a 400 TBN (oil free basis) calcium alkylated phenate detergent, wherein the alkyl group is derived from a $C_{20}$ to $C_{24}$ isomerized normal alpha olefin and wherein the isomerization level of the alpha olefin is about 0.26.

The lubricating oil composition of Examples 1, 3-7, and Comparative Examples 2, 8-9 were subjected to a Komatsu Hot Tube Test and TEOST MHT4 as described below. The results of these tests are set forth below in Table 2.

Komatsu Hot Tube Test (KHTT)

The Komatsu Hot Tube Test (KHTT) is used for screening and quality control of deposit formation performance for engine oils and other oils subjected to high temperatures.

Detergency and thermal and oxidative stability are performance areas that are generally accepted in the industry as being essential to satisfactory overall performance of a lubricating oil. The Komatsu Hot Tube test is a lubrication industry bench test (JPI 5S-55-99) that measures the detergency and thermal and oxidative stability of a lubricating oil. During the test, a specified amount of test oil is pumped upwards through a glass tube that is placed inside an oven set at a certain temperature. Air is introduced in the oil stream before the oil enters the glass tube, and flows upward with the oil. Evaluations of the lubricating oils were conducted at a temperature of 280° C. The test result is determined by comparing the amount of lacquer deposited on the glass test tube to a rating scale ranging from 1.0 (very black) to 10.0 (perfectly clean).

TEOST MHT4

TEOST MHT4 (ASTM D7097-16a) is designed to predict the deposit-forming tendencies of engine oil in the piston ring belt and upper piston crown area. Correlation has been shown between the TEOST MHT procedure and the TU3MH Peugeot engine test in deposit formation. This test determines the mass of deposit formed on a specially constructed test rod exposed to repetitive passage of 8.5 g of engine oil over the rod in a thin film under oxidative and catalytic conditions at 285° C. Deposit-forming tendencies of an engine oil under oxidative conditions are determined by circulating an oil-catalyst mixture comprising a small sample (8.4 g) of the oil and a very small (0.1 g) amount of an organo-metallic catalyst. This mixture is circulated for 24 hours in the TEOST MHT instrument over a special wire-wound depositor rod heated by electrical current to a controlled temperature of 285° C. at the hottest location on the rod. The rod is weighed before and after the test. Deposit weight of 45 mg is considered as pass/fail criteria.

A copy of this test method can be obtained from ASTM International at 100 Barr Harbor Drive, PO Box 0700, West Conshohocken, Pa. 19428-2959 and is herein incorporated for all purposes.

TABLE 2

| | Ex. 1 | Comp. Ex. 2 | Ex. 3 | Ex. 4 | Ex. 5 | Ex. 6 | Ex. 7 | Comp. Ex. 8 | Comp. Ex. 9 |
|---|---|---|---|---|---|---|---|---|---|
| TEOST MHT4 deposits (mg) | 59.7 | 57.1 | 51.8 | 33.7 | 46.5 | 43.2 | 52.5 | 44.2 | 56.5 |
| KHT (Merit Rating) | 6 | 4.5 | 5 | 8 | 6 | 6.5 | 5 | 4 | 3.5 |

The data in Table 2 show clear detergency, and thermal and oxidative stability benefits of the lubricating oil performance of the present disclosure (Examples 1, and 3 to 7) over Comparative Examples 2, 8 and 9.

It will be understood that various modifications may be made to the embodiments disclosed herein. Therefore, the above description should not be construed as limiting, but merely as exemplifications of preferred embodiments. For example, the functions described above and implemented as the best mode for operating the present disclosure are for illustration purposes only. Other arrangements and methods may be implemented by those skilled in the art without departing from the scope and spirit of this disclosure. Moreover, those skilled in the art will envision other modifications within the scope and spirit of the claims appended hereto.

What is claimed is:

1. A lubricating oil composition comprising:

(a) a major amount of an oil of lubricating viscosity (b) an overbased metal salt of an alkyl-substituted phenate detergent, wherein the alkyl group is derived from an isomerized normal alpha olefin having from about 10 to about 40 carbon atoms per molecule and having an isomerization level (I) of the normal alpha olefin of from about 0.1 to about 0.4 in an amount to provide at least 1000 ppm of calcium, (c) one or more magnesium-containing detergents having about 100 to about 1000 ppm of magnesium, based on the total weight of the lubricating oil composition;

(d) one or more zinc dialkyl dithiophosphate compounds, wherein at least one zinc dialkyl dithiophosphate is derived from a primary alcohol; and (e) one or more zinc dialkyl dithiophosphate compounds derived from a secondary alcohol, wherein the molar ratio of the primary alcohol of the one or more zinc dialkyl dithiophosphate compounds derived from a primary alcohol to the secondary alcohol of the one or more zinc dialkyl dithiophosphate compounds derived from a secondary alcohol is from 80:20 to 20:80.

2. The lubricating oil composition of claim 1, wherein the major amount of the oil of lubricating viscosity is greater than 50 wt. %, based on the total weight of the lubricating oil composition.

3. The lubricating oil composition of claim 1, wherein the alkyl group of the alkyl-substituted phenate detergent is derived from an isomerized normal alpha olefin having from about 14 to about 30.

4. The lubricating oil composition of claim 1, wherein the alkyl group of the alkyl-substituted phenate detergent is derived from an isomerized normal alpha olefin having from about 20 to about 28.

5. The lubricating oil composition of claim 1, wherein the isomerized normal alpha olefin of the alkyl-substituted phenate detergent has an isomerization level (I) of from about 0.10 to about 0.30.

6. The lubricating oil composition of claim 1, wherein the overbased metal salt of an alkyl-substituted phenate detergent has a total base number (TBN) of from about 100 to about 600 mg KOH/gram on an oil free basis.

7. The lubricating oil composition of claim 1, wherein the overbased metal salt of an alkyl-substituted phenate detergent is an overbased calcium salt of an alkyl-substituted phenate detergent.

8. The lubricating oil composition of claim 1, wherein the one or more magnesium-containing detergents are one or more of a magnesium sulfonate, magnesium phenate, and a magnesium salicylate.

9. The lubricating oil composition of claim 1, wherein the one or more magnesium-containing detergents are one or more overbased magnesium-containing detergents.

10. The lubricating oil composition of claim 1, further comprising one or more zinc dialkyl dithiophosphate compounds derived from a secondary alcohol, wherein the molar ratio of the primary alcohol of the one or more zinc dialkyl dithiophosphate compounds derived from a primary alcohol to the secondary alcohol of the one or more zinc dialkyl dithiophosphate compounds derived from a secondary alcohol is from about 80:20 to about 20:80.

11. The lubricating oil composition of claim 1, comprising from about 10 ppm to about 5000 of metal derived from the overbased metal salt of the alkyl-substituted phenate detergent, based on the total weight of the lubricating oil composition and about 0.01 wt. % to about 0.12 wt. % of phosphorus derived from the one or more zinc dialkyl dithiophosphate compounds, based on the total weight of the lubricating oil composition.

12. The lubricating oil composition of claim 1, further comprising at least one additive selected from the group consisting of antioxidants, rust inhibitors, dehazing agents, demulsifying agents, metal deactivating agents, friction modifiers, pour point depressants, antifoaming agents, co-solvents, corrosion-inhibitors, ashless dispersants, multi-functional agents, dyes, extreme pressure agents and mixtures thereof.

13. A method comprising the step of operating an internal combustion engine with a lubricating oil composition comprising (a) a major amount of an oil of lubricating viscosity (b) an overbased metal salt of an alkyl-substituted phenate detergent, wherein the alkyl group is derived from an isomerized normal alpha olefin having from about 10 to about 40 carbon atoms per molecule and having an isomerization level (I) of the normal alpha olefin of from about 0.1 to about 0.4, (c) one or more magnesium-containing detergents having about 100 to about 2000 ppm of magnesium, based on the total weight of the lubricating oil composition;

(d) one or more zinc dialkyl dithiophosphate compounds, wherein at least one zinc dialkyl dithiophosphate is derived from a primary alcohol; and (e) one or more zinc dialkyl dithiophosphate compounds derived from a secondary alcohol, wherein the molar ratio of the primary alcohol of the one or more zinc dialkyl dithiophosphate compounds derived from a primary alcohol to the secondary alcohol of the one or more zinc dialkyl dithiophosphate compounds derived from a secondary alcohol is from 80:20 to 20:80.

14. The method of claim 13, wherein the alkyl group of the alkyl-substituted phenate detergent is derived from an isomerized normal alpha olefin having from about 20 to about 28 and an isomerization level (I) of from about 0.10 to about 0.30.

15. The method of claim 13, wherein the overbased metal salt of an alkyl-substituted phenate detergent has a TBN of from about 100 to about 600 mg KOH/gram on an oil free basis.

16. The method of claim 13, wherein the one or more magnesium-containing detergents are one or more of a magnesium sulfonate, magnesium phenate, and a magnesium salicylate.

17. The method of claim 13, wherein the lubricating oil composition further comprises one or more zinc dialkyl dithiophosphate compounds derived from a secondary alcohol, wherein the molar ratio of the primary alcohol of the one or more zinc dialkyl dithiophosphate compounds derived from a primary alcohol to the secondary alcohol of the one or more zinc dialkyl dithiophosphate compounds derived from a secondary alcohol is from about 80:20 to about 20:80.

18. The method of claim 13, wherein the lubricating oil composition comprises from about 10 ppm to about 5000 of metal derived from the overbased metal salt of the alkyl-substituted phenate detergent, based on the total weight of the lubricating oil composition and about 0.01 wt. % to about 0.12 wt. % of phosphorus derived from the one or more zinc dialkyl dithiophosphate compounds, based on the total weight of the lubricating oil composition.

19. The method of claim 13, wherein the lubricating oil composition further comprises at least one additive selected from the group consisting of antioxidants, rust inhibitors, dehazing agents, demulsifying agents, metal deactivating agents, friction modifiers, pour point depressants, antifoaming agents, co-solvents, corrosion-inhibitors, ashless dispersants, multifunctional agents, dyes, extreme pressure agents and mixtures thereof.

20. The method of claim 13, wherein the internal combustion engine is a compression ignition engine.

* * * * *